United States Patent [19]

Voris

[11] Patent Number: 4,691,916

[45] Date of Patent: Sep. 8, 1987

[54] EXERCISE APPARATUS WITH TROLLEY SYSTEM

[75] Inventor: Harvey C. Voris, Garden Grove, Calif.

[73] Assignee: Paramount Fitness Corporation, Los Angeles, Calif.

[21] Appl. No.: 691,033

[22] Filed: Jan. 9, 1985

[51] Int. Cl.[4] ..... A63B 21/06

[52] U.S. Cl. ..... 272/118; 272/143

[58] Field of Search ..... 272/118, 143, 134, 93, 272/117, 120, 123

[56] References Cited

U.S. PATENT DOCUMENTS

| | | | |
|---|---|---|---|
| Re. 28,066 | 7/1974 | Marcyan . | |
| Re. 31,170 | 3/1983 | Mazman | 272/118 |
| 1,114,458 | 10/1914 | Friedli | 272/118 |
| 1,905,352 | 4/1933 | Porter | 272/118 |
| 3,612,523 | 10/1971 | Glynn . | |
| 3,635,472 | 1/1972 | Marcyan . | |
| 3,807,728 | 4/1974 | Chillier . | |
| 3,815,903 | 6/1974 | Blomqvist . | |
| 3,905,599 | 9/1975 | Mazman . | |
| 3,912,263 | 10/1975 | Yatso . | |
| 3,971,555 | 2/1975 | Mahnke | 272/118 |
| 4,010,947 | 3/1977 | Lambert, Sr. | 272/118 |
| 4,093,214 | 6/1978 | Coker et al. | 272/118 |
| 4,199,139 | 4/1980 | Mahnke et al. | 272/118 |
| 4,200,280 | 4/1980 | Goodwin | 272/118 |
| 4,208,049 | 6/1980 | Wilson | 272/138 |
| 4,317,566 | 3/1982 | Uyeda et al. | 272/118 |
| 4,339,125 | 7/1982 | Uyeda et al. | 272/118 |
| 4,346,888 | 8/1982 | Szabo | 272/118 |
| 4,354,675 | 10/1982 | Barclay | 272/118 |
| 4,411,424 | 10/1983 | Barnett | 272/118 |
| 4,456,246 | 6/1984 | Szabo | 272/118 |
| 4,470,596 | 9/1984 | Desiderio | 272/118 |

*Primary Examiner*—Richard J. Apley
*Assistant Examiner*—Robert W. Bahr
*Attorney, Agent, or Firm*—M. John Carson

[57] ABSTRACT

An exercise apparatus having a trolley directly linked to the resistance weights. Bearings on the trolley react against the eccentric component of an applied force, while a selector bar connecting the trolley with the weights interacts with the weight stack to keep the trolley bearings in continuous contact with upright guide rods on which the trolley and weights ride when a user withdraws his controlled grip of the press bar or the lat pull down bar, removing any externally applied force.

15 Claims, 4 Drawing Figures

FIG. 3
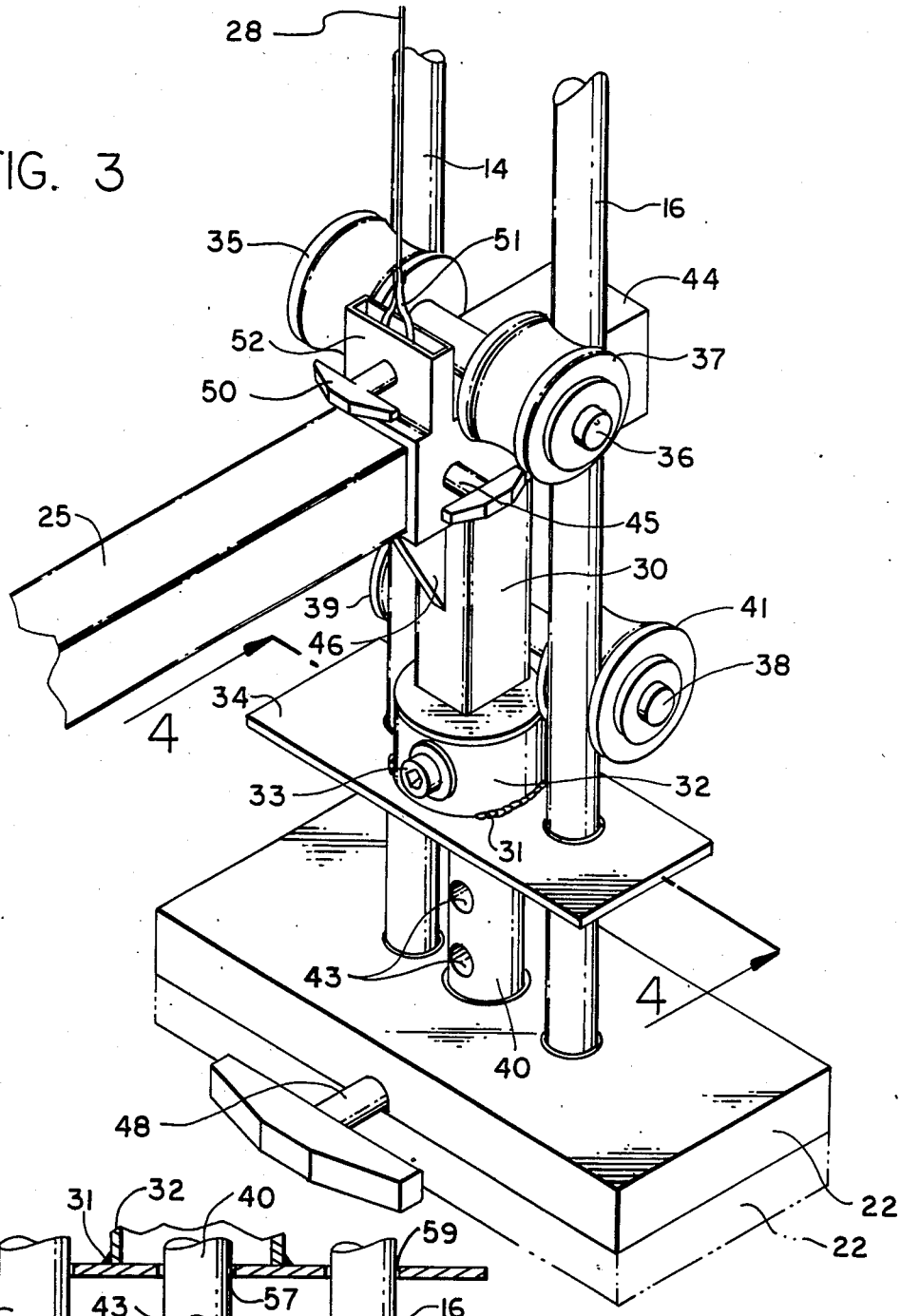
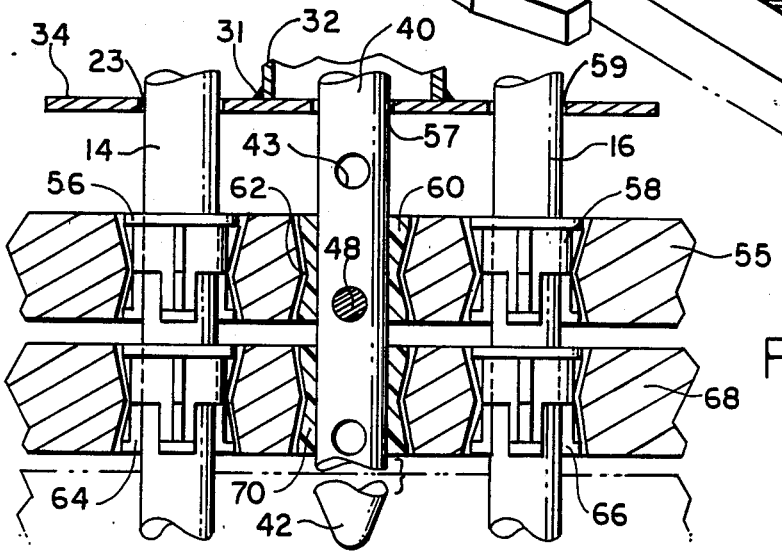
FIG. 4

EXERCISE APPARATUS WITH TROLLEY SYSTEM

FIELD OF THE INVENTION

This invention relates to the exercise art, and more particularly to an exercise apparatus having an improved, simplified trolley system capable of maintaining control between the trolley and guide rods when a user releases his grip on the press bar or the lat pull down bar withdrawing any externally applied force.

BACKGROUND OF THE INVENTION

Muscular strength is developed and enhanced by the use of exercise apparatus. Traditional apparatus, such as dumbbells and barbells, have been used for progressive exercises. However, the use of such exercise apparatus carries hidden dangers when undertaken by the inexperienced person without proper supervision. For example, barbells present difficult balancing problems which increase the risk of serious injury.

More recently, various types of progressive weight training machines have been suggested to overcome problems inherent in the use of barbells and dumbbells. When first developed, such machines were of great height and bulk. In return for safety, these machines required substantially more floor space than was required for barbells.

Specialized weight lifting exercising apparatus have included components such as an upstanding frame having a track, one or more weights which may be selectively introduced, a trolley mounted on the track and operatively connected to the weights, and a means for applying force to lift the weights, such as a handle bar disposed outward from the trolley or a Latissimus or lat pull down bar connected to the trolley through a cable system.

In pulley-connected cable systems, the extent which a trolley may travel is limited by the height of the unit and by the height of the room in which the device is stored. Additionally, most pulleys require a top horizontal frame to provide a place where the pulley may be fixed. Thus, lateral space limitations also restrict pulley-connected weight lifting apparatus. Furthermore, the trolley of pulley-connected weight lifting apparatus often directs eccentric forces against the vertical frame. In pulley-connected exercise devices, eccentric forces which tend to destabilize the frame structure are imparted to the machine when a lifting force is applied and also when the user withdraws his controlled grip of the press bar or the lat pull down bar, removing any externally applied force.

Conventionally designed pulley-connected trolley systems have wheels affixed to the trolley which ride on the outer surface of guide rods or tracks and substantially surround the rod in order to resist and react to the eccentric forces. U.S. Pat. No. 1,114,458 to Friedli and U.S. Pat. No. 4,346,888 to Szabo are examples of such a trolley construction. At least three sets of wheels surround each track in these patents to oppose eccentric forces. Such design is complicated and costly to fabricate.

Alternatively, other exercise machines having a cable and pulley operatively connecting the trolley to the weight stack have trolley wheels contained within flanged channels or tracks. Examples include U.S. Pat. No. 1,905,352 to Porter, U.S. Pat. No. 3,807,728 to Chillier, and U.S. Pat. No. 3,635,472 (reissued as U.S. Pat. No. RE 28,066) to Walter Marcyan. Another example of a cable and pulley system exercise apparatus is U.S. Pat. No. 3,815,903 to Blomqvist. Such designs are difficult to fabricate. Additionally, the trolley wheels may bind or otherwise be captured while rolling within an enveloping trackway.

An alternative class of exercise machine which eliminates the necessity for a pulley and cable system is one having an upright supporting structure containing vertical tracks, a vertically reciprocative trolley mounted in and guided by the tracks, and weights supported in the upright structure connected directly to the trolley by means of a selector bar. A shoulder press or chess press handle bar may be connected to the trolley for imparting a lifting force. This single station class of exercise machine must cope with eccentric forces just as the cable and pulley system machines.

One variety of this selector bar connected trolley and weight stack exercise device has linear bearings forming an inner sleeve completely surrounding the guide rods. An example of such an apparatus is U.S. Pat. No. 4,470,596 to Desiderio. Other examples having separate linear bearing sleeves used for reciprocity of the trolley movement include U.S. Pat. No. 4,093,214 to Coker, et al., and U.S. Pat. No. 4,208,049 to Wilson. Each of these patents require special fabrication of a bearing for use within the body of the trolley. The constant motion of the trolley as it rides through vertical tracks increases the likelihood of wear and tear on the bearing members. Linear ball bearings are provided in U.S. Pat. No. 4,010,947 to Lambert, Sr. These ball bearings ride within the sleeves of the trolley body and completely surround the guide rods to offset all eccentric forces.

Linear bearing sleeves functioning to allow the trolley reciprocal movement along the guide rods require lubrication and maintainance. Being specially molded or fabricated, they are costly and of complicated design.

U.S. Pat. No. 4,354,675 to Barclay, et al. has at least four sets of opposingly disposed wheels fixed to the trolley to resist all eccentric forces. When a lifting force is applied to the trolley in Barclay, the upper rearward set of wheels and the lower forward set of wheels are pressed to the guide bar and resist the eccentric forces of lift. When the applied forces are released, the upper forward wheels and the lower rearward wheels engage the track. In U.S. Pat. No. 3,612,523 to Glynn, the lifting force is applied in a parallel but different plane from the trolley. Like Barclay, each trolley has four sets of opposingly disposed wheels. Both Barclay and Glynn require a minimum of four sets of wheels to resist all eccentric forces arising during exercise.

Trolleys requiring multiple sets of wheels, such as Barclay or Glynn, use these wheels to bear all eccentric forces. This increases the likelihood that the wheels will wear out quickly. A trolley-equipped exercise device should provide a better means for distributing the eccentric forces which arise during operation of the device.

In U.S. Pat. No. 3,912,263 to Yatso, and U.S. Pat. No. 4,317,566 to Uyeda, et al., the trolley wheels move within vertical tracks along an inner bar contained within the tracks. The guide tracks in both patents require channeled construction. In U.S. Pat. No. 4,200,280 to Goodwin, and U.S. Pat. No. 4,411,424 to Barnett, the channels are customized to surround and encompass the trolley wheels disposed within the channels. The flanges are of substantial depth to securely guide and direct trolley reciprocative movement. Such designs allow the trolley wheels to bind or otherwise drag against the channel walls.

U.S Pat. Nos. 3,971,555 and 4,199,139, both to Mahnke, disclose specially designed axle wheels which securely fit into a V-shaped, grooved, channelled guide track. The wheels disposed within such specially designed tracks require special fabrication and are costly to manufacture, produce, and replace. Wheels riding within a flange track may grab or bind the track, limiting the ability of the trolley to display smooth reciprocal motion. Also, the above-described devices are not useful for exercises using the lat pull down bar.

SUMMARY OF THE INVENTION

The present invention is an improved exercise apparatus which has a frame support structure including guide rods, resistance means such as weights mounted on the guide rod, a trolley reciprocally mounted on the guide rods and a selector bar rigidly connected to the trolley, which selector bar can carry slidable weights mounted on the guide rods and progressively interacts with stationary weights as the user withdraws his controlled grip of the press bar or the lat pull down bar, removing any externally applied force.

More specifically, the trolley comprises an elongated housing defining a vertically directed first sleeve positioned between the guide rods for receiving the upper end of the selector bar. Affixed to the housing at its proximal end is a second sleeve mounted to the housing and defining a passageway for receiving one end of a press bar or other means for directing an applied force to the trolley. Mounted above the second sleeve is a cable retaining chamber disposed forward from the housing for receiving a cable eyelet to be attached to one end of a cable system. The cable is normally connected at its other end to a lat pull down bar. The cable retaining chamber allows interchangeable use of the exercise system for pull as well as press or push exercises.

Disposed at only two spaced-apart locations along the guide rods are two sets of coaxial roller wheels. The axles of both sets of wheels are secured to opposite sides of the trolley housing. One set of wheels is disposed along the rear surface of the guide rods, while the upper proximal set of wheels is disposed along the front opposite surface of the guide rods. The housing is rigidly fastened to the selector bar by a pin which bayonets a preselected hole in the selector bar to prevent pivoting or rotating of the selector bar relative to the trolley housing. The lower end of the selector bar is connected by means of a conventional retaining pin to a preselected number of weights. In this manner, the carriage, selector bar, and weights form substantially a single, rigid operational structure on the guide rods.

This simplified design allows the roller wheels to provide the necessary resistance to the eccentric component of only the applied force. These wheels engage opposing sides of the guide rods.

When a user withdraws his controlled grip of the press bar or the lat pull down bar, the externally applied force is removed. The present invention uses the selector bar, which progressively interacts with stationary weights, rather than an additional set of wheels to counteract a second eccentric force which arises upon the withdrawal of the externally applied force. This interaction of the selector bar with the weights, trolley and guide rods keeps the trolley continuously mounted on the guide rods without need for an additional set of roller wheels.

BRIEF DESCRIPTION OF THE DRAWINGS

The present invention may be more fully understood from the following detailed description taken in conjunction with the accompanying drawings, wherein:

FIG. 3 is a fragmented perspective view of the trolley disposed on the guide rods and connected through the selector bar to the resistance weights; and, FIG. 4 is a vertical, cross-sectional view taken along the line 4—4 of FIG. 3 showing a cross-section of the resistance weights, illustrating the interaction of the selector bar with the weights, and showing a full side view of the bushings 56, 58 and 64, 66 which surround the guide rods 14 and 16.

DETAILED DESCRIPTION OF THE PREFERRED EMBODIMENT

Figure 1:
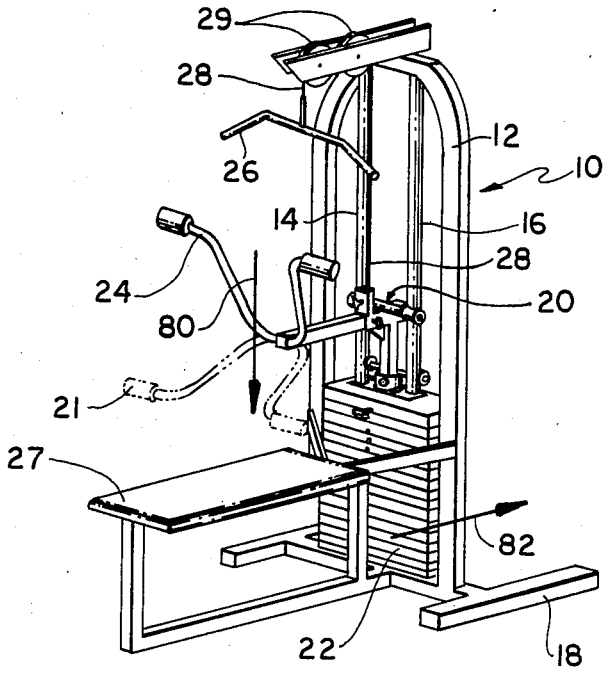
FIG. 1 is a perspective view showing the exercise apparatus constructed in accordance with the present invention.

Turning to the drawings, FIG. 1 shows an exercise apparatus 10 with an improved trolley system generally designated 20. The exercise apparatus frame 12 is conventionally formed in a downward U-shape supported by the base 18. Disposed and centrally positioned within the frame 12 are the vertical guide rods 14 and 16. Below the trolley system are situated individually selectable resistance weights forming a weight stack 22.

Turning to FIG. 4, a cross-section of an individual weight 55 is shown, fastened to the selector bar 40 by the weight retention pin 48. This weight 55 and any additionally selected weights above the weight 55, ride reciprocally up and down the guide rods 14 and 16 connected by the selector bar 40 to the trolley 20 (FIG. 1). The stationary weight 68 is representative of one of many remaining weights which are not connected to the trolley 20 but remain seated on a resilient shock absorbing bracket (not shown) which collars the guide rods 14 and 16 and is positioned above the support base 18 of FIG. 1.

With reference to FIG. 1, a press bar 24 is connected to the trolley system 20 by means of an arm 25. In its upward position, the press bar 24 may be used by an individual seated on the bench 27 for shoulder press exercises. The press bar 24 and the arm 25 may be removed, rotated 180 degrees, and reinserted in a downward depending position as shown at 21. This chest press bar position 21 is conventionally used by an individual lying on his back on the bench 27 with his head toward the weights 22 to do a chest press. Thus, two separate exercise modes using the press bar 24 are provided.

The lat pull down bar 26 allows an alternative exercise whereby the user pulls down on the lat pull down bar 26 in opposition to resistance produced by the weights 22. To use of the lat pull down bar 26, one would remove the press bar 24, sit on the bench 27, and pull on the lat pull down bar 26. The pull down bar 26 is connected at one end of the cable 28. The cable 28 is journaled across the pulleys 29, and connected at the other end to the trolley 20. The trolley 20 is connected to the weights 22 so that when the user exerts a force on the lat pull down bar 26, the weights 22 offer resistance in the same manner that the weights 22 resist applied force to the press bar 24.

Figure 2:
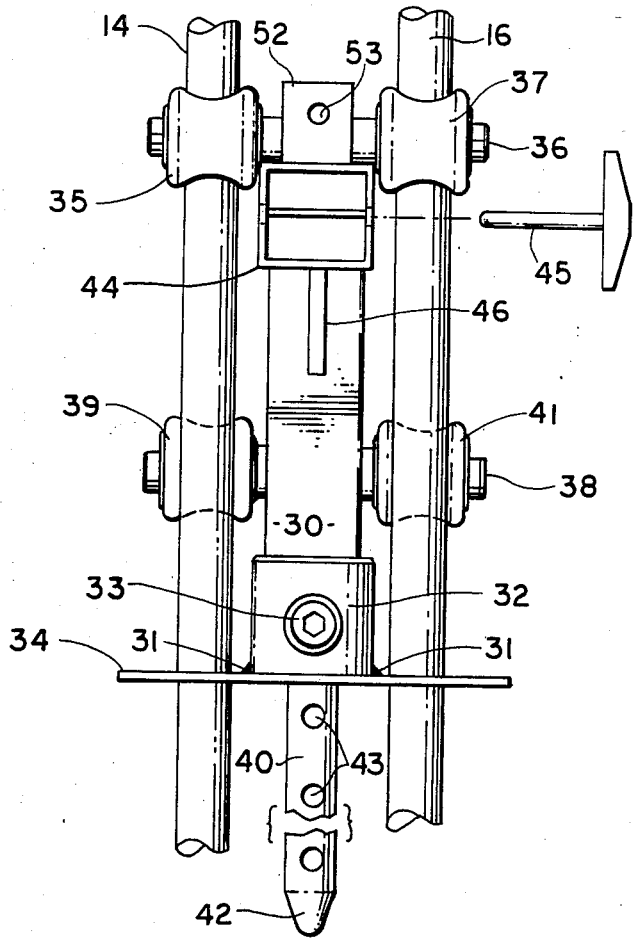
FIG. 2 is a front elevational fragmented view showing the trolley system as it rides along the guide rods.

FIG. 2 shows a detailed view of the improved trolley system 20. The trolley system 20 includes a vertically disposed, hollow rectangular metal housing 30 and a hollow metal cylindrical plate retention housing 32 welded to the distal end of the vertical housing 30. The plate housing 32 is welded at 31 or otherwise secured to a metal collar plate 34, which in the preferred embodiment is a flat plate orthogonally disposed across the bottom of the plate retention housing 32. The collar plate 34 is designed to be of sufficent size to prevent the removal of the trolley 20 accidently off the guide rods 14 and 16 (FIGS. 1 and 2). The collar plate 34 normally rests atop the upper selected weight from the weight stack 22 during operational use. FIG. 3 shows the collar plate 34 and the trolley 20 lifted to illustrate a variation in the positioning of the plate 34 with respect to the weight stack 22. The securing bolt 33 is inserted in the first hole (not shown) of holes 43 in the selector bar 40. This prevents pivoting or rotation of the bar 40 with respect to the trolley 20 and aligns the distal holes 43 of the bar 40 with central, horizontally disposed grooves (not shown) within the weights 22 depending on the desired starting position. The bolt 33 is secured at its distal end to the retention housing 32 by a locknut (not shown).

The collar plate 34 has apertures 23, 57, and 59 (FIG. 4) which slidably receive the guide rod 14, the selector bar 40, and the guide rod 16, respectively.

Turning to FIGS. 2 and 3, the trolley 20 is mounted for reciprocal movement along the guide rods 14 and 16. This movement is accomplished in the preferred embodiment by only two sets of wheels. A first set of the wheels 35 and 37 is disposed coaxially on an axle 36, which is welded to the forward top of the retention sleeve 44, and a second set of wheels 39 and 41 is disposed on the axle 38, which is welded to the lower rear of the vertical housing 30, on the opposite side of the rods 14 and 16 from the wheels 35 and 37. The axles 36 and 38 are mounted on opposite sides of the guide rods 14 and 16 and towards opposite ends of the housing 30.

A hollow metal press bar retention sleeve 44 is welded horizontally to the top end of the housing 30. The press bar retention pin 45 is removable for securing the press bar arm 25 in the press bar retention sleeve 44. The pin 45 bayonets through apertures in the sides of the sleeve 44 which are designed to register with coincident apertures located on opposing sides of the distal end of the press bar arm 25 (not shown). The sleeve brace 46 supports the press bar retention sleeve 44 against the housing 30. A hollow, rectangular metal cable retention housing 52 is situated to the top of the press bar retention sleeve 44 and forward of the axle 36. The cable retention housing 52 has a hole 53 (FIG. 2) for receiving a cable retention pin 50 (FIG. 3) to engage the cable eyelet 51.

The selector bar 40 is a solid, substantially cylindrical metal rod with evenly spaced apart holes 43 through the bar 40. The holes 43 are adapted to receive the weight retention pin 48 (FIG. 3) to interconnect the trolley 20 with the weights 22. At the proximal end of the selector bar 40 is a selector bar tip 42 which passes through the central bushing 70 of the weights 68.

FIG. 3 shows how the starting position for the trolley 20 is set. By threading the securing bolt 33 through one of the upper most selector bar holes 43 as shown in FIGS. 2 and 3, the securing bolt 33 is securely fastened to prevent the trolley 20 from pivoting or rotating with respect to the selector bar 40. The trolley 20, fastened to the selector bar 40, is raised or lowered along the guide rods 14 and 16, and the weight retention pin 48 is placed through the lowest selected weight, bayoneting the selector bar 40 through one of its holes 43, so that the trolley is set in the proper starting position. The selector bar 40 has no freedom of independent movement once it is fastened by the securing bolt 33 to the trolley 20. When the user withdraws his control from the trolley 20 and the externally applied force is withdrawn, the trolley 20, secured to the selector bar 40, is guided down the guide rods 14 and 16 while the selector bar 40 is centered within the bushing 70.

Unlike the conventional art, no wheels are provided to oppose the eccentric forces arising when a user releases his grip on the lat pull down bar 26 or the press bar 24, withdrawing any externally applied force. Instead, as the selector bar 40 proceeds into the bushing 70 of the stationary weight 68 (See FIG. 4), the selector bar 40 interacts with the bushing 70 in opposition to the resulting inertial forces, and interacts with the bushing 60 at all times if the weight 55 is selected. The bushings 56 and 58 of the selected weight 55 interact with the guide rods 14 and 16 preventing movement of the selector bar 40 in any direction other than vertically when the selector bar 40 is fixed to the trolley 20, to keep the trolley 20 aligned with respect to the guide rods 14 and continuously on course.

The bushings are situated in customized mountings, such as the bushing 60 mounted at position 62. This allows the bushings to float within narrow toleraces as the bushings react to eccentric forces. The bushings 64 and 66 seated within the stationary weight 68 assist the bushing 70 in opposing eccentric forces as the bushing 70 interacts with the selector bar 40.

It should be noted that the cable retention housing 52 and the press bar retention sleeve 44 are positioned for an optimum balance of the moments of inertia of the trolley 20, the selector bar 40, and the selected weights 22, to allow maximum stability of the frame 12 and reactance to the eccentric forces arising when a user releases his grip on the lat pull down bar 26 or the press bar 24, withdrawing any externally applied force. Turning to FIG. 1, the direction of the resultant inertial forces are at the center of gravity of the press bar 24, as illustrated by the arrow 80. The reactive eccentric forces arising are shown at the arrow 82, and these reactive eccentric forces are opposed by the interaction of the selector bar 40 with the bushing 70.

FIG. 4 is illustrative of the operational mechanism of this invention which does not need more than two sets of wheels for the trolley 20. The weight 55 is secured to the selector bar 40 by the weight retention pin 48 and moves with the trolley 20 as it reciprocally rides the guide rods 14 and 16. It can be appreciated that any number of additional weights may ride atop the weight 55 and thereby also move with the trolley 20. The selector bar 40 is designed to have more holes 43 than the number of weights in the weight stack 22 and be of greater height than the weight stack 22. As the selector bar 40 descends with the trolley 20 and the weight 55 affixed to bar 40, the user releases his grip on the press bar 24 or lat pull down bar 26 and withdraws any externally applied force from the trolley 20. The selector bar 40 interacts with the bushing 70 of the stationary weight 68 and progressively interacts with the central bushings of all remaining stationary weights situated below weight 68.

In this manner, the trolley remains continuously on the guide rods 14 and 16. Additionally, the descending weight 55 has bushings 56 and 58 which interact with the guide rods 14 and 16 to insure stability to the trolley system. The interaction of the selector bar 40 with the selected weights and stationary weights, the rigid securement of the selector bar 40 to the trolley 20, and the proper positioning of the press bar retention sleeve 44 and the cable retention housing 52 are factors which eliminate the need for any additional sets of wheels, such as a set positioned opposite either wheel set 35, 37 or 39, 41.

In the preferred embodiment, all of the bushings are made of high impact organic polymer material.

It should be noted that the preferred embodiment is illustrative of an exercise machine with an improved trolley. The scope of the invention is not necessarily limited to the preferred embodiment. Many structural changes are possible and those changes are intended to be within the scope of this disclosure. For example, the trolley wheels about the axles 36 and 38 could be replaced with opposingly disposed bearings positioned at only two locations along the trolley 20. Consequently, the specific structural and functional details of the exercise apparatus are merely representative, yet they are deemed to afford the best embodiment for purposes of the disclosure and for providing support for the claims which define the scope of the present invention.

I claim:

1. An exercise apparatus, comprising:

a frame support structure;

at least one guide rod secured to the support structure;

a plurality of resistance weights slidably disposed on said at least one guide rod;

a trolley slidably connected by coupling means to the at least one guide rod for upward and downward movement, the coupling means comprising only two sets of rollers which sets are vertically spaced apart and are positioned only on opposite sides of said at least one guide rod;

means for applying force to the trolley positioned on the same side of said at least one guide rod as the uppermost set of said rollers; and means for connecting the trolley to one or more of the resistance weights and for interacting with the resistance weights to help maintain the alignment of the trolley on said at least one guide rod.

2. The exercise apparatus of claim 1, wherein said at least one guide rod comprises a pair of vertical guide rods which are secured parallel to one another and to support structure.

3. An exercise apparatus comprising:

a frame support structure;

at least one guide rod disposed within the frame support structure;

at least one resistance weight slidably disposed on said at least one guide rod; and a trolley, the trolley comprising means for directing an applied force acting in opposition to the resistance weight, the force directing means acting to translate the applied force into a primary component opposing the resistance weight and a secondary eccentric component;

bearing means for opposing the eccentric component, the bearing means being spaced-apart and having only two areas of engagement with said at least one guide rod, said areas being disposed in transverse opposition to each other; and means for connecting the trolley to the resistance weight, the connecting means being positioned to proceed into the resistance weight to oppose an eccentric component of force incidental to be withdrawal of the applied force so that the bearing means remain continuously in contact with said at least one guide rod.

4. An exercise apparatus as in claim 3, including a pulley and a cable, the cable having a means for attaching to the trolley at one end, and a means for applying external force to the other end of the cable.

5. An exercise apparatus as in claim 4, wherein the connecting means is adjustable for positioning the trolley relative to the resistance weight, so that the position of the force directing means may be adjusted to accommodate the user.

6. An exercise apparatus as in claim 3, wherein the trolley further includes a trolley housing comprising:

a first sleeve for receiving the connecting means;

a second sleeve for receiving the force directing means;

a first set of wheels disposed at the upper end of the housing for rolling contact with a first surface of said at least one guide rod; and a second set of wheels mounted at the lower end of the housing for rolling contact with a second surface of said at least one guide rod, transversely opposite the first surface.

7. An exercise apparatus as in claim 4, wherein the trolley comprises a means for linking to the cable attachment means so that the bearing means oppose the eccentric component of the applied force and the connecting means proceeds into the resistance weight in response to the withdrawal of the applied force.

8. An exercise apparatus as in claim 6, further comprising:

a base;

a plurality of stacked and aligned weights, comprising connecting weights and stationary weights, each weight having a central aperture for receiving the connecting means, the stationary weights resting at the base of the frame support structure, and the connecting weights attached to the connecting means;

a selector bar having a plurality of spaced-apart holes positioned to attach to a selected number of connecting weights, the number of holes being greater than the number of weights, so that the selector bar may accommodate the selection of any number of connecting weights for attachment to the selector bar;

pin means for attaching a selected number of weights to the selector bar through the lowest selected weight and a hole in the selector bar; and bolt means for linking the trolley to the selector bar by alignment of the trolley with one hole of the selector bar.

9. An exercise apparatus comprising:

a frame structure including an upright pair of uniformly spaced-apart guide rods and a support base for the guide rods;

a plurality of weights stacked above the support base and disposed within the frame, each weight having at least a central aperture, each aperture providing a seat for mounting a bushing;

a plurality of resilient bushings mounted on the seats in the apertures of the weights;

an adjustable force directing means for imparting an external lifting force for action in opposition to the weights;

a reciprocally mounted trolley including, an elongated disposed housing, defining a first sleeve extending the length of the housing, an elongated second sleeve disposed at a proximal end of the housing for receiving the force directing means, means for operatively connecting a cable to the second sleeve, and only two sets of coaxial wheels, the axles of each set of wheels secured to the trolley, a first set of wheels being in contoured engagement with the one surface of the guide rods, and the second set of wheels in contoured engagement with the opposite surface of the vertical guide rods;

a selector bar disposed through the central apertures of the entire stack of weights and protruding from the stack for insertion into the housing sleeve adapted to contact the bushings mounted in the aperture of the weights when the external lifting forces is withdrawn, the selector bar having a plurality of spaced apart holes greater in number than the number of weights so the selector bar may connect the trolley with the desired number of weights and accomodate adjustable positioning of the trolley.

10. An exercise apparatus as in claim 9, wherein the weights each further define a set of side apertures for receiving the guide rods, each such aperture providing a seat for mounting the bushings, so that the guide rods interact with the bushings of those descending weights which ride the rods when the applied force is withdrawn.

11. An exercise apparatus as in claim 9, wherein the resilient bushings are each of generally frusto-conical configuration; and, the selector bar has a distal tip disposed to enter the bushing along the central axis of the bushing, the inner walls of the bushing interacting with the selector bar tip to maintain the linear positioning of the selector bar as the trolley descends when the applied force is withdrawn.

12. An exercise apparatus as in claim 9, wherein the cable connecting means includes a hook engagement means affixed to the trolley for attaching one end of the cable to the trolley, the hook engagement means positioned to receive the cable at a distance sufficient for the bearing means to engage the guide rods in balanced equilibrium with the tension arising in the cable.

13. An exercise apparatus as in claim 9, wherein the adjustable force directing means includes:

a press bar having a handlebar for gripping, and a press bar arm for removable insertion into the trolley tube;

the press bar arm being adjustably pinned to the tube so that the handlebar may be positioned in one of at east two configurations.

14. An exercise apparatus comprising:

a frame support structure having a support base and at least a pair of spaced-apart guide rods mounted within the frame;

a plurality of aligned weights disposed within the frame and stacked above the support base, the weights comprising selected weights and stationary weights, the selected weights selected to ride along the guide rods and the stationary weights remaining stacked above the support base, each weight having at least a central aperture for mounting a bushing;

a plurality of bushings mounted in the central apertures of the weights;

means for directing a lifting force against the weights;

a trolley mounted for reciprocal movement on the guide rods, comprising an elongated first hollow housing;

a second elongated hollow housing mounted at the proximal end of the first housing receiving a press bar;

two sets of coaxial concave roller wheels, one set of wheels disposed toward the distal end of the first housing, being in rolling engagement with a surface of the guide rods, and the second set of wheels mounted atop the second housing, being in rolling engagement with the opposite surface of the guide rods; and a selector bar connecting the weights and the trolley, positioned partially within the central apertures of the weights for interactive contact with the bushings of the weights, the selector bar having at least a plurality of evenly-spaced holes of sufficient number so that the selector bar may be adjusted to align with a selected number of weights, and the trolley may be adjustably mounted at one of a variety of starting positions.

15. An exercise apparatus as in claim 14, wherein the selector bar traverses through the center of the bushings, its sides interacting progressively with the bushings of stationary weights when the applied force is withdrawn.

* * * * *

UNITED STATES PATENT AND TRADEMARK OFFICE

CERTIFICATE OF CORRECTION

PATENT NO. : 4,691,916
DATED : September 8, 1987
INVENTOR(S) : Harvey C. Voris

It is certified that error appears in the above-identified patent and that said Letters Patent are hereby corrected as shown below:

IN THE SPECIFICATION:

Column 1, line 46, "forcesagainst" should be --forces against--

Column 2, line 37, "maintainance" should be --maintenance--

Column 6, line 33, "toleraces" should be --tolerances--

IN THE CLAIMS:

Column 7, line 54, before "support" insert --the--

Column 10. line 10, "east" should be --least--

Column 10, line 30, before "receiving" insert --for--

Signed and Sealed this

Twenty-ninth Day of March, 1988

*Attest:*

DONALD J. QUIGG

*Attesting Officer*

*Commissioner of Patents and Trademarks*